United States Patent [19]

Sasaoka et al.

[11] Patent Number: 4,920,034

[45] Date of Patent: Apr. 24, 1990

[54] SILVER HALIDE PHOTOGRAPHIC MATERIAL AND IMAGE FORMING METHOD USING THE SAME

[75] Inventors: Senzo Sasaoka; Nobuaki Inoue, both of Kanagawa, Japan

[73] Assignee: Fuji Photo Film Co., Ltd., Kanagawa, Japan

[21] Appl. No.: 352,613

[22] Filed: May 15, 1989

Related U.S. Application Data

[63] Continuation of Ser. No. 918,443, Oct. 14, 1986, abandoned.

[30] Foreign Application Priority Data

Oct. 17, 1985 [JP] Japan ..... 60-232086

[51] Int. Cl.[5] ..... G03C 1/06

[52] U.S. Cl. ..... 430/264; 430/502; 430/571; 430/949

[58] Field of Search ..... 430/264, 502, 571, 949

[56] References Cited

U.S. PATENT DOCUMENTS

| | | | |
|---|---|---|---|
| 3,888,676 | 6/1975 | Evans | 430/571 |
| 4,209,329 | 6/1980 | Lohner | 430/502 |
| 4,506,008 | 3/1985 | Sugimoto et al. | 430/502 |
| 4,560,638 | 12/1985 | Loblaw et al. | 430/949 |
| 4,681,836 | 7/1987 | Inoue et al. | 430/264 |
| 4,761,362 | 8/1988 | Sasaoka et al. | 430/267 |

FOREIGN PATENT DOCUMENTS

| | | | |
|---|---|---|---|
| 2166559A | 5/1986 | United Kingdom | 430/502 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A silver halide photographic material and an image forming method using such material are described, said material comprising a surface latent image forming silver halide emulsion layer unit on a support, and containing a hydrazine compound in at least one of said emulsion layer unit and other constituent layers, said emulsion layer unit being composed of at least two layers, with the silver halide emulsion present in a fine-grained low-sensitivity emulsion layer having a minimum average grain size being not more than 80% of the average grain size of a coarse-grained high-sensitivity silver halide emulsion having the maximum average grain size, and said silver halide photographic material attains a contrast of 10 or more in terms of gamma value when a developer containing at least 0.15 mol/liter of sulfite ions and having a pH of from 9.5 to 12.3 is used.

18 Claims, 1 Drawing Sheet

SILVER HALIDE PHOTOGRAPHIC MATERIAL AND IMAGE FORMING METHOD USING THE SAME

This is a continuation of U.S. application Ser. No. 06/918,443 filed Oct. 14, 1986, now abandoned.

FIELD OF THE INVENTION

The present invention relates to a silver halide photographic material that is suitable for use in the field of photomechanical processes and which is capable of rapid formation of a super-high contrast image with a highly stable processing solution.

BACKGROUND OF THE INVENTION

It is known that a very high-contrast photographic image can be formed using a certain kind of silver halide, and various methods for forming such a photographic image are employed in the field of photo mechanical processes.

According to one method, a lith-type silver halide light-sensitive material comprising silver chlorobromide (at least 50 mol % of which is silver chloride) is processed with a hydroquinone developer having a very low effective concentration of sulfite ions (usually not more than 0.1 mol/liter) so as to obtain a halftone image or line original having high contrast and optical density wherein image areas are clearly distinguished from nonimage areas. However, the development achieved by this method is extremely liable to aerial oxidation because of the low sulfite concentration in the developer, and various efforts and approaches have been necessitated to stabilize the activity of the developer.

Under the situation described above, it has been desired to devise an image-forming system that eliminates the instability in image formation by the aforementioned developing method (lith development system) and which provides super high contrast photographic characteristics by development with a processing solution having improved stability during storage. In response to this need, systems capable of forming super high contrast negative images ($\gamma > 10$) have been described in U.S. Pat. Nos. 4,166,742, 4,168,977, 4,221,857, 4,224,401, 4,243,739, 4,272,606, and 4,311,781; according to the described methods, surface latent-image type silver halide photographic materials to which specified acylhydrazine compounds have been added are processed at a pH between 11.0 and 12.3 with developers that contain at least 0.15 mol/liter of a preservative sulfurous acid and which exhibit good stability during storage. The new image-forming systems permit the use of silver iodobromide or silver chloroiodobromide, which is a definite advantage over the previously described methods for forming super high contrast images which can be implemented solely by the use of silver chlorobromide with high silver chloride content.

With the commonly employed silver halide photographic materials, the optical density of an image obtainable per unit amount of developed silver increases in inverse proportion to the size of silver halide grains but, on the other hand, the sensitivity of a silver halide generally increases in the size of silver halide grains. Therefore, in order to obtain a light-sensitive material that provides both high sensitivity and high optical density, it is necessary that a silver halide emulsion having a large grain size be incorporated in an increased amount per unit area. However, light-sensitive material containing a larger amount of silver halide emulsion is not adaptive to rapid processing, since it takes a prolonged time to fix, wash, and dry the developed material. In addition, silver is a precious metal whose world production and reserves are limited, so that it is economically advisable to produce light-sensitive materials with minimum use of silver.

Under these circumstances, studies have been conducted for many years in order to realize the production of silver halide light-sensitive materials having high image density and sensitivity while using silver in a reduced amount.

The new image-forming systems described above which are capable of forming extremely high contrast images in high speed have a serious disadvantage in that they sometimes cause the formation of "black pepper" due to infectious development, and this presents a problem in photomechanical processes.

"Black pepper" refers to the formation of tiny black spots of developed silver that occur in the areas which would otherwise be unexposed nonimage areas. Black pepper tends to occur more frequently if the pH of the processing solution increases, for reasons such as fatigue with time. While extensive efforts have been made in order to prevent the occurrence of black pepper, success in reducing the formation of black pepper is often accompanied by a decrease in sensitivity or image contrast. Therefore, it has been desired to devise a system that maintains high-sensitivity and super high contrast photographic characteristics but yet is capable of satisfactory prevention of black pepper.

SUMMARY OF THE INVENTION

One object, therefore, of the present invention is to provide a silver halide photographic material that undergoes minimal formation of black pepper but yet is capable of achieving a high-speed and high-contrast image with an increased optical density.

Another object of the present invention is to provide an image-forming method using said silver halide photographic material.

The first object of the present invention can be attained by a silver halide photographic material comprising a surface latent-image type silver halide emulsion layer unit on a support, and containing a hydrazine compound in at least one of said emulsion layer unit and other constituent layers, said emulsion layer unit being composed of at least two layers, with the silver halide emulsion present in a fine-grained low-sensitivity emulsion layer having a minimum average grain size being not more than 80% of the average grain size of a coarse-grained high-sensitivity silver halide emulsion having the maximum average grain size, and said silver halide photographic material attains a contrast of 10 or more in terms of gamma value when a developer containing at least 0.15 mol/liter of sulfite ions and having a pH of from 9.5 to 12.3 is used.

The second object of the present invention can be attained by an image-forming method wherein the aforementioned silver halide photographic material is subjected to an imagewise exposure and subsequently developed with a developer that contains at least 0.15 mol/liter of sulfite ions and which has a pH of from 9.5 to 12.3, so as to provide a gamma value of 10 or more.

Figure 1:
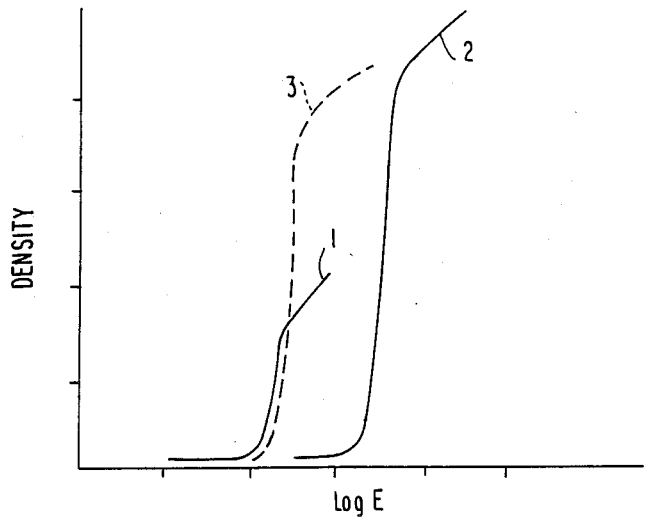
FIG. 1 shows characteristic curves as obtained in accordance with the present invention, wherein curve 1 refers to the use of a single coarse-grained emulsion layer, curve 2 to the use of a single fine-grained emulsion layer, and curve 3 to the use of a dual structure wherein a coarse-grained emulsion layer is combined with a fine-grained emulsion layer.
Figure 2:
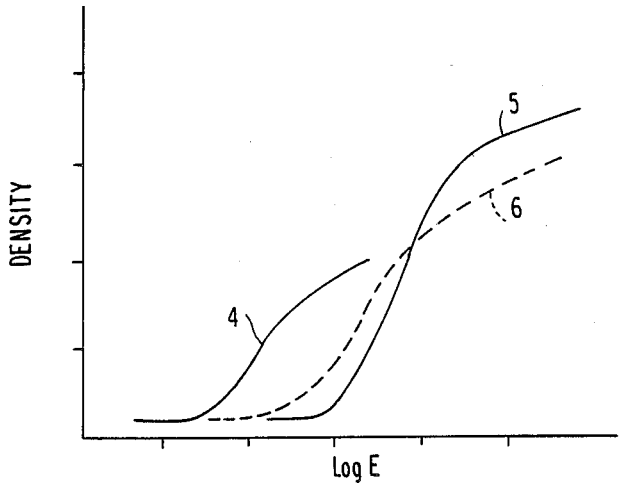
FIG. 2 shows characteristic curves as typical of those obtained in the prior art, wherein curve 4 refers to the use of a single coarse-grained emulsion layer, curve 5 to the use of a single fine-grained emulsion layer, and curve 6 to the use of a dual structure wherein a coarse-grained emulsion layer is combined with a fine-grained emulsion layer.

In both of FIGS. 1 and 2, the abscissa shows the logarithm of the exposure amount (log E), and the ordinate shows the optical density after processing of the development (Density).

DETAILED DESCRIPTION OF THE INVENTION

The terminology "average grain size" as used herein refers to the average size of all of the silver halide grains present in a particular silver halide emulsion layer. Furthermore, the average grain size refers to the diameter of the grains when the silver halide grains are spherical or similar to spherical grains, or indicates a calculated diameter value based on projected areas of the grains in the case of nonspherical type grains (e.g., such as cubic grains).

The processes for determining the average grain size are described in detail in C. E. Mees & T. H. James, *The Theory of the Photographic Process,* 3rd Ed., pp. 36–43, MacMillan (1966).

If a hydrazine derivative is incorporated in emulsion layers, it may be present in at least one of such emulsion layers. Alternatively, the hydrazine derivative may be contained in more than one emulsion layer or even in all of the emulsion layers used.

The high sensitivity and high optical density ($D_{max}$) desired in the present invention are attainable only with a light-sensitive material that provides a super high contrast characteristic having a gamma value of 10 or more, and which contains a hydrazine derivative.

In the present invention, at least two surface latent-image type silver halide emulsions having different average grain sizes are used, and in particular, two surface latent-image type silver halide emulsions are preferably used. The following description assumes the use of two such silver halide emulsions. The emulsion having the large average grain size is more sensitive than the other emulsion having the smaller average size but has the disadvantage of a smaller optical density D per unit amount of silver M (D/M =covering power). When the two emulsions having different grain sizes are applied to form a double-layered emulsion coat, the sensitivity attained is much lower than that of the coarse-grained emulsion and approaches that of the fine-grained emulsion as shown in FIG. 2 if the gamma value is smaller than 10 in the absence of any hydrazine derivative. On the other hand, as shown in FIG. 1, the system of the present invention which incorporates a hydrazine derivative displays the advantage of an increased $D_{max}$ while substantially retaining the sensitivity of the coarse grains Characteristic curves 1 to 3 in FIG. 1 and curves 4 to 6 in FIG. 2 assume the case of using the same amount of silver coated, provided that in a double-layered structure, the coarse- and fine-grained emulsions are used in weight ratios of 25 wt % and 75 wt % , respectively, and the amount of silver coated is the same as in the case of using either the coarse-grained or fine-grained emulsion alone. The above-described advantage of the present invention results from infectious development that proceeds with the hydrazine derivative being used as an active species. The hydrazine derivative active species that is generated as result of development of the exposed coarse grain is thought to render the surrounding unexposed grains (fine grains) developable in an image-related manner so as to attain a high contrast characteristic.

The advantages attained by the system of the present invention are remarkable in that the formation of black pepper is reduced, and yet an increased $D_{max}$ is obtained with a negligible decrease in sensitivity. Such advantages are absent from processing with a lith developer (i.e., the prior art system of providing a super high contrast characteristic by infectious development using an extremely low level of sulfite ions but without using any hydrazine derivative) and have been entirely unexpected from the prior art technology. In the system of the present invention, infectious development by the active species provided by the hydrazine derivative is important and a gamma value of 10 or more is obtained if such infectious development progresses actively. Therefore, particularly good results are attained by the present invention under conditions that provide a gamma value of 10 or more.

The light-sensitive material of the present invention uses two or three or more emulsion layers (preferably two emulsion layers) and is hereinafter described with respect to the case where two emulsion layers are used.

There is no particular limitation on the silver halide grains used in a two-layered emulsion coat consisting of an 0-layer (the layer remote from the support) and a U-layer (the one closer to the support) but the average grain size is preferably large, and, from a sensitivity viewpoint, it is advantageous that the higher-sensitivity emulsion is present in the 0-layer. The fine-grained emulsion may be unsensitized chemically but more preferably it is chemically sensitized. Methods that can be used to chemically sensitize the fine-grained emulsion are described later in this speicification and include such known techniques as sulfur sensitization, reduction sensitization and gold sensitization. The coarse-grained emulsion may or may not be chemically sensitized. The difference in sensitivity between the coarse-grained high-sensitivity emulsion and the fine-grained low-sensitivity emulsion that are preferably used in the present invention is not limited to any particular value, but preferably the difference is from 0.1 to 1.0, and more preferably from 0.2 to 0.7, in terms of $\Delta$ log E. The silver halide emulsions have an average grain size which preferably ranges from 0.02 to 1.0 $\mu$ m, and more preferably from 0.1 to 0.5 $\mu$ m. It is preferable that the average grain sizes of the coarse and fine grains are included within these ranges.

The fine-grained emulsion having a minimum average grain size is preferably applied such that the amount of silver coated is from 40 to 90 wt % of the total silver content, with from 50 to 80 wt % being more preferable, of the emulsion layer unit.

The halide composition of the silver halide emusions used in the present invention is in no way limited and they may composed of any silver halide such as silver chloride, silver bromide, silver chlorobromide, silver iodobromide, silver iodochloride, or silver iodochlorobromide. If two emulsions are used, their halide compositions may be the same or different.

The silver halide emusions used in the present invention may be prepared by any of the methods known in the art of silver halide photographic materials, such as those described in P. Glafkides, *Chimie et Physique Photographique,* Paul Montel Co., Paris (1967); G. F. Duffin, *Photographic Emulsion Chemistry,* The Focal Press, London (1966); and V. L. Zelikman et al., *Making and Coating Photographic Emulsions,* The Focal Press, London (1964). Furthermore, the silver halide emulsions and the process for preparing the same are described in detail in *Research Disclosure,* Vol. 176, No. 17643, pages 22–23 (December 1978). The water-soluble silver salt (an aqueous solution of silver nitrate) may be reacted with a water-soluble halide salt by either the single-jet method, the double-jet method or a combination thereof. One application of the double-jet method is what is called the "controlled double jet method" wherein the pAg is held constant in a liquid phase where silver halide is being formed. Silver halide grains may also be formed by using a "silver halide solvent" such as ammonia, thioether, or tetra-substituted thiourea.

Grain formation by the controlled double-jet method using a silver halide solvent allows for easy preparation of a silver halide emulsion having a regular crystal shape and a narrow grain-size distribution, and hence is an effective means for obtaining an emulsion that is suitable for use in the present invention.

The silver halide grains in the photographic emulsion may have a regular crystal shape such as cubic or octahedral, or they may have an irregular crystal shape, such as spherical or plate-like.

The grain size distribution is preferably narrow and it is preferable that at least 90%, and more preferably at least 95%, of the total number of silver halide grains lies within the range of grain sizes which are ±40% of the average grain size (such an emulsion is generally called a monodisperse emulsion).

The silver halide grains may be homogeneous throughout the interior thereof, or, alternatively, they may be composed of a core and shell which have different phases.

During the formation or physical ripening of the silver halide grains to be incorporated in the silver halide emulsion used in the present invention, cadmium salts, zinc salts, lead salts, thallium salts, iridium salts or complexes thereof, rhodium salts or complexes thereof may also be present.

The silver halide emulsion used in the present invention may or may not be chemically sensitized. Methods for chemical sensitization which can be used include known techniques such as sulfur sensitization, reduction sensitization and gold sensitization, which may be employed either independently or in combination.

Gold sensitization is a typical method of noble metal sensitization and is implemented with a gold compound which is typically a gold complex salt. Complex salts of other noble metals such as platinum, palladium and iridium may also be used. Specific examples of such complex salts are described in U.S. Pat. No. 2,448,060 and British Patent Ser. No. 618,061.

Sulfur sensitizing agents which may be used include not only the sulfur compounds present in gelatin but also a variety of other sulfur compounds such as thiosulfates, thioureas, thiazoles and rhodanines. Specific examples of the sulfur sensitizing agents are shown in U.S. Pat. Nos. 1,574,944, 2,278,947, 2,410,689, 2,728,668, 3,501,313, and 3,656,955.

Usable reduction sensitizers include stannous salts, amines, formamidine sulfinic acid, and silane compounds, and specific examples are described in U.S. Pat. Nos. 2,487,850, 2,518,698, 2,983,609, 2,983,610, and 2,694,637.

The silver halide emulsions used in the present invention may be optically sensitized with a view to attaining increased sensitivity and providing a light sensitivity in a desired wavelength range. Sensitizing dyes such as cyanine and merocyanine dyes may be used either independently or in combination to achieve spectral sensitization or supersensitization.

Details of such sensitization techniques are described in U.S. Pat. No. 2,688,545, 2,912,329, 3,397,060, 3,615,635, and 3,628,964; Japanese Patent Publication Nos. 4936/68 and 14030/69; and Japanese Patent Application (OPI) No. 52050/80 (the term "OPI" as used herein means a "published unexamined Japanese Patent application").

Preferable examples of hydrazine derivatives which may be used in the present invention are the arylhydrazides of the type described in U.S. Pat. No. 4,478,928 wherein the sulfinic acid residue is bonded to the hydrazo portion, and compounds represented by formula (I)

$$R_1—NHNH—G—R_2 \quad (I)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group.

The aliphatic group denoted by $R_1$ in formula (I) preferably has 1 to 30 carbon atoms, with a straight-chained, branched or cyclic alkyl group having from 1 to 20 carbon atoms being particularly preferable. The branched alkyl group may be cyclized in such a manner that a saturated hetero ring containing one or more hetero atoms may be formed. The alkyl group may have a substituent such as an aryl, alkoxy, sulfoxy, sufonamido or carbonamido group.

The aromatic group denoted by $R_1$ is a monocyclic or bicyclic aryl group or an unsaturated hetero cyclic group, the latter being optionally condensed with a mono- or bicyclic aryl group to form a heteroaryl group. Illustrative aromatic groups include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, and those which contain a benzene ring are particularly preferable.

As aryl group is particularly preferable as $R_1$. The aryl group or unsaturated hetero cyclic group as $R_1$ may have a substituent and typical substituents include a straight-chained, branched, or cyclic alkyl group (preferably having from 1 to 20 carbon atoms), an aralkyl group (which is preferably a mono- or bicyclic aralkyl group wherein the alkyl moiety has 1 to 3 carbon atoms), an alkoxy group (preferably having from 1 to 20 carbon atoms), a substituted amino group (preferably one which is substituted by an alkyl group with from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms).

The alkyl group denoted by $R_2$ is preferably one having from 1 to 4 carbon atoms and may have a substituent such as a halogen atom, a cyano group, a carboxy group, a sulfo group, an alkoxy group or a phenyl group.

The optionally substituted aryl group denoted by $R_2$ is a mono- or bicyclic aryl group which may contain a benzene ring. This aryl group may be substituted by, for example, a halogen atom, an alkyl group, a cyano group, a carboxyl group, or a sulfo group.

The optionally substituted alkoxy group denoted by $R_2$ is one having from 1 to 8 carbon atoms and may be substituted, for example, by a halogen atom or an aryl group.

The optionally substituted aryloxy group denoted by $R_2$ is preferably monocyclic and may have a substituent such as a halogen atom.

Preferable examples of the group denoted by $R_2$ are listed below: when G is a carbonyl group, they are hydrogen atom, a methyl group, a methoxy group, an ethoxy group, a substituted or unsubstituted phenyl group, with the hydrogen atom being particularly preferable; when G is a sulfonyl group, preferable examples of $R_2$ are a methyl group, an ethyl group, a phenyl group, or a 4-methylphenyl group, with the methyl group being particularly preferable; when G is a phosphoryl group, preferable examples of $R_2$ are a methoxy group, an ethoxy group, a butoxy group, a phenoxy group, and a phenyl group, with the phenoxy group being particularly preferable; when G is a sulfoxy group, preferable examples of $R_2$ are a cyanobenzyl group and a methylthiobenzyl group; and when G is an N-substituted or unsubstituted iminomethylene group, preferable examples of $R_2$ are a methyl group, an ethyl group, and a substituted or unsubstituted phenyl group.

A ballast group which is commonly employed in couplers and of the immobile photographic additives may be incorporated in $R_1$ or $R_2$. The ballast group is one having at least 8 carbon atoms which is comparatively inert to photographic properties; a suitable ballast group may be selected from among alkyl, alkoxyl, phenyl, alkylphenyl, phenoxyl and alkylphenoxy groups.

A group which provides enhanced adsorpotion to the surface of silver halide grains may also be incorporated in $R_1$ or $R_2$. Illustrative adsorptive groups include a thiourea group, a heterocyclic thioamido group, a mercapto heterocyclic group and a triazole group, and such are described in U.S. Pat. No. 4,385,108.

A carbonyl group is most preferable as G in the formula (I).

Specific examples of the compounds represented by formula (I) are listed below, but it should be noted that these examples of compound (I) do not limit the scope of the present invention.

I-1

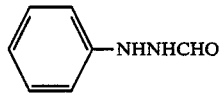

I-2

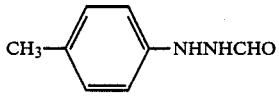

I-3

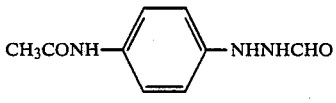

I-4

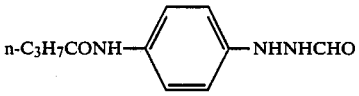

I-5

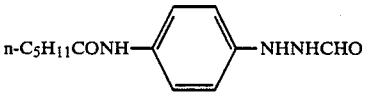

I-6

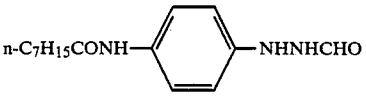

I-7

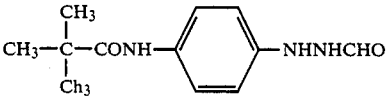

-continued
I-8
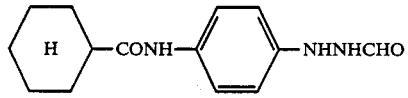
I-9
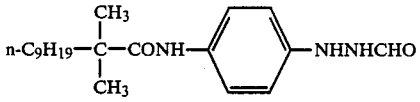
I-10
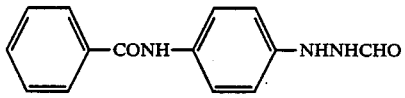
I-11
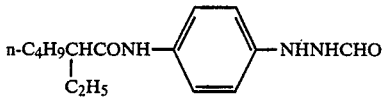
I-12
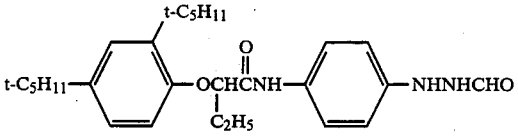
I-13
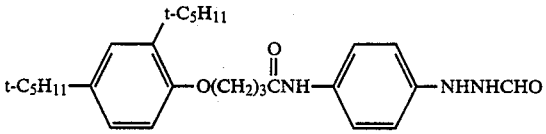
I-14
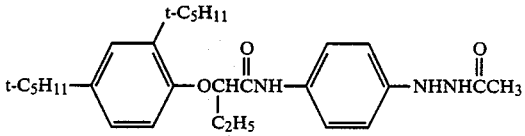
I-15
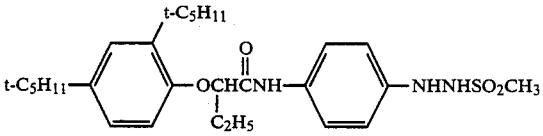
I-16
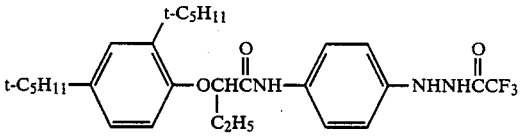
I-17
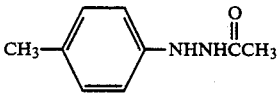
I-18
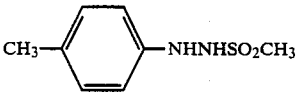
I-19
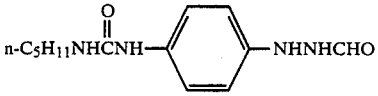

-continued
I-20
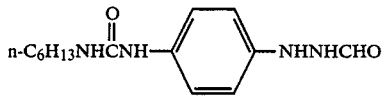
I-21
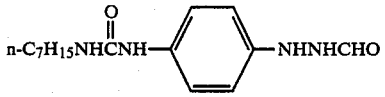
I-22
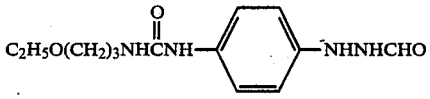
I-23
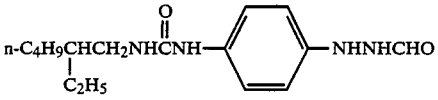
I-24
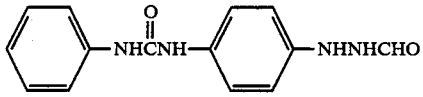
I-25
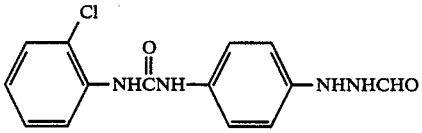
I-26
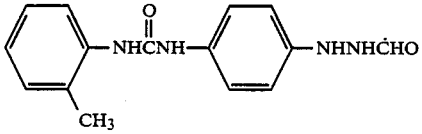
I-27
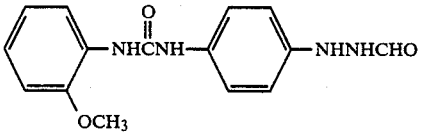
I-28
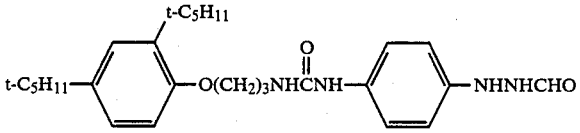
I-29
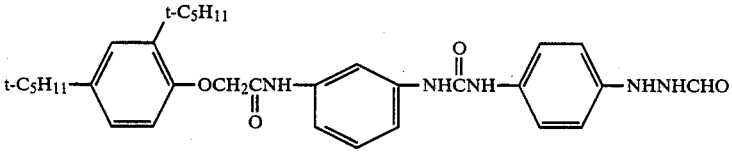
I-30
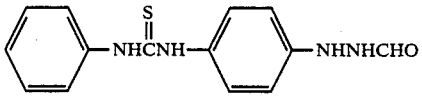

-continued

I-31

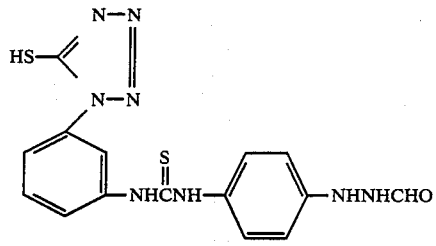

I-32

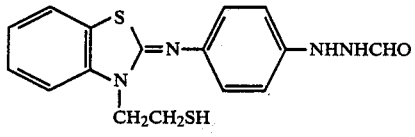

I-33

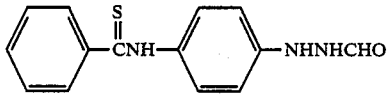

I-34

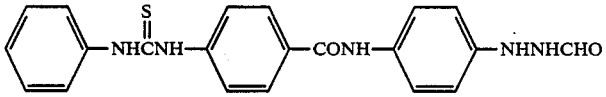

I-35

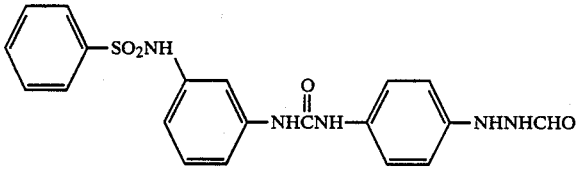

The compounds represented by formula (I) are preferably incorporated in amounts of from $1\times10^{-6}$ to $5\times10^{-2}$ moles per mole of silver halide, with the range of from $1\times10^{-5}$ to $2\times10^{-2}$ moles being particularly preferable.

The compounds of formula (I) may be incorporated in a photographic material in the following manner: if they are water-soluble, aqueous solutions thereof are added to a solution of silver halide emulsion (e.g., coarse-grained emulsion, or fine-grained emulsion) or a hydrophilic colloid solution; if the compounds are water-insoluble, they are added in the form of a solution in a water-miscible organic solvent such as an alcohol (e.g., methanol or ethanol), an ester (e.g., ethyl acetate) or a ketone (e.g., acetone) to a solution of silver halide emulsion (e.g., course-grained emulsion, or fine-grained emulsion) or a hydrophilic colloid solution.

If the compounds of formula (I) are to be added to a solution of silver halide emulsion, the addition may be conducted at any point of time during the time interval from the start of chemical ripening to the application of the coating solution. Addition after completion of the chemical ripening is preferable, and it is particularly preferable to add the compounds to a coating solution prepared for application of the emulsion.

The photographic emulsion used in the present invention may contain various compounds for the purpose of preventing the occurrence of fogging during the manufacture, storage or photographic processing of the light-sensitive material or for stabilizing its photographic performance. Many compounds that are known in the art as anti-foggants or stabilizers may be used for these purposes and they include: azoles such as benzothiazolium salts, nitroindazoles, nitrobenzimidazoles, chlorobenzimidazoles, bromobenzimidazoles, mercaptothiazoles, mercaptobenzpyothiazoles, mercaptobenzimidazoles, mercaptothiadiazoles, amino-triazoles, benzotriazoles, nitrobenzotriazoles, and mercaptotetrazoles (e.g., 1-phenyl-5-mercaptotetrazole); mercaptopyrimidines; mercaptotriazines; thioketo compounds such as oxadolinethione; azaindenes such as triazaindenes, tetrazaindenes (e.g., 4-hydroxy-substituted (1,3,3a,7) tetrazaindenes) and pentazaindenes; benzenethiosulfonic acid, benzenesulfinic acid and benzenesulfonic acid amide.

Of these compounds, benzotriazoles (e.g., 5-methylbenzotriazole) and nitroindazoles (e.g., 5-nitroindazole) are particularly preferable. These compounds may be incorporated in a processing solution.

The photographic material of the present invention may contain inorganic or organic hardening agents in photographic emulsion layers or other hydrophilic colloidal layers. Suitable hardening agents, which may be used either independently or in combination, include: chromium salts (e.g., chrome alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g., 2,4-dichloro-6-hydroxy-s-triazine), and mucohalogenic acids (e.g., mucochloric acid and mucophenoxychloric acid).

The photographic emulsion layers and other hydrophilic colloidal layers in the light-sensitive material that is prepared in accordance with the present invention may contain various surface active agents for attaining various purposes such as, for example, assisting in coating operations, improving anti static properties, providing improved sliding properties, achieving emulsification or dispersion, preventing adhesion and providing improved photographic characteristics (e.g., accelerating the rate of development, increasing contrast, or providing sensitization). Suitable surface active agents are listed below: nonionic surfactants such as saponin (steroid type), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines or amides, and polyethylene oxide adducts of silicone), glycidol derivatives (e.g., alkenyl-succinic acid polyglycerides and alkylphend polyglycerides), aliphatic acid esters of polyhydric alcohols, and alkyl esters of saccharides; anionic surfactants containing acidic groups such as a carboxyl group, a sulfo group, a phospho group, a sulfate group, or a phosphate group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkyl phosphoric acid esters; amphoteric surfactants such as amino acids, aminoalkylsulfonic acids, aminoalkylsulfate or phosphate esters, alkylbetaines, and amine oxides; and catinonic surfactants such as alkylamine salts, aliphatic or aromatic quaternary ammomium salts, heterocyclic quaternary ammonium salts (e.g., pyridinium and imidazolium salts), and aliphatic or heterocyclic phosphonium or sulfonium salts.

Surface active agents which are preferably used in the present invention are the polyalkylene oxides described in U.S. Pat. No. 4,221,857 which have molecular weights of 600 or more.

The photographic material of the present invention may also contain dispersions of water-insoluble or sparingly water-soluble synthetic polymers in photographic emulsion layers or other hydrophilic colloidal layers for the purpose of improving the dimensional stability thereof. Illustrative polymers are those of monomers such as alkyl (meth)acrylates, alkoxyalkyl (meth)acrylates. glycidyl (meth)acrylates, (meth)acrylamides, vinyl esters (e.g., vinyl acetate), acrylonitrile, olefins and styrene, which may be used either individually or in combination, or polymers of these monomers combined with other monomeric components such as acrylic acid, methacrylic acid, $\alpha$, $\beta$-unsaturated dicarboxylic acids, hydroxyalkyl (meth)acrylates, sulfoalkyl (meth)acrylates, and styrenesulfonic acid.

With a view to reducing black pepper, the pH of the emulsion coat may be reduced by using inorganic acids, organic acids, or acidic polymers as described in U.S. Patent Application Serial Nos. 845,298 (filed on March 28, 1986) and 846,679 (filed on Apr. 1, 1986).

Photographic processing of the silver halide photographic material of the present invention does not require the use of the conventional lith developer which has an extremely low level of the effective concentration of sulfite ions or the highly alkaline (pH about 13) developer shown in U.S. Pat. No. 2,419,975. A super high contrast negative image may be formed by processing the photographic material of the present invention with a developer of the type described below.

The developing agent that can be incorporated in the developer suitable for use in the present invention is not limited to any particular compound, but in view of that good dot quality is liable to be obtained, the developer preferably contains a dihydroxybenzene, which may be combined with a 1-phenyl-3-pyrazolidone or p-aminophenol.

Illustrative dihydroxybenzene compounds suitable for use as developing agents include hydroquinone, chlorohydroquinone, bromohydroquinone, isopropyl hydroquinone, methyl hydroquinone, 2,3-dichlorohydroquinone, 2,5-dichlorohydroquinone, 2,3-dibromohydroquinone, and 2,5-dimethyl hydroquinone, with hydroquinoe being particularly preferable.

Illustrative 1-phenyl-3-pyrazolidone and derivatives thereof which are suitable for use as developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxy-methyl-3-pyrazolidone, 1-phenyl-5-methyl-3-pyrazolidone, 1-p-aminophenyl-4,4-dimethyl-3-pyrazolidone, and 1-p tolyl-4,4-dimethyl-3-pyrazolidone.

Illustrative p-aminophenolic compounds which are suitable for use as developing agents include N-methyl-p-aminophenol, p-aminophenol, N-($\beta$-hydroxyethyl)-p-aminophenol, N-(4-hydroxyphenyl)glycine, 2-methyl-p-aminophenol and p-benzylaminophenol, with N-methyl-p-aminophenol being particularly preferable.

The developing agents shown above are preferably used in amounts which generally range from 0.05 to 0.8 moles per liter. If dihydroxybenzenes are used in combination with 1-phenyl-3-pyrazolidones or p-aminophenols, the former is preferably used in an amount of from 0.05 to 0.5 moles per liter, while the latter is preferably used in an amount not exceeding 0.06 moles per liter.

Illustrative sulfites which is used as preservatives in the developer used in the present invention include sodium sulfite, potassium sulfite, lithium sulfite, ammonium sulfite, sodium bisulfite, potassium metabisulfite, and formaldehyde sodium bisulfite. Among of these, sodium sulfite and potassium sulfite are preferably used. These sulfites are preferably present in concentrations of 0.15 moles or more per liter, with concentrations of at least 0.4 moles per liter being more preferable. The upper limit of the sulfite content is preferably 2.5 moles per liter.

In the present invention, alkaline agents may be used to achieve pH adjustment and pH adjusters or buffers such as sodium hydroxide, potassium hydroxide, sodium carbonate, potassium carbonate, tertiary sodium phosphate and terriary potassium phosphate may be used as alkaline agents.

Other additives that may be incorporated in the silver halide photographic material of the present invention include development restrainers such as boric acid, borax, sodium bromide, potassium bromide and potassium iodide; organic solvents such as ethylene glycol, diethylene glycol, triethylene glycol, dimethylformamide, methyl cellosolve, hexylene glycol, ethanol and methanol; and anti-foggants or black pepper preventing agents such as mercapto compounds (e.g., 1-phenyl-5-mercaptotetrazole and 2-mercaptobenzimidazole-5-sulfonic acid sodium salt), indazole compounds (e.g., 5-nitroindazole), and benzotriazole compounds (e.g., 5-methyl-benzotriazole). If desired, the silver halide photographic material of the present invention may further contain other additives such as toning agents, surface active agents, defoaming agents, hard water softeners, hardening agents, and amino compounds as described in Japanese Patent Application (OPI) No. 106244/81.

In accordance with the image-forming method of the present invention, negative images having super high contrast characteristics ($\gamma > 10$) may be attained by rapid-access processing (development time ranging from 15 to 60 seconds) with the stable developer described above. The temperature for processing in accordance with the method of the present invention is typically selected from the range of 18 to 50° C.

Fixing solutions having commonly employed formulations may be used in the present invention. Suitable fixing agents include are thiosulfates, thiocyanates, and any of the organic sulfur compounds that are known to be effective as fixing agents. The fixing solution may contain a water-soluble aluminum salt as a hardening agent.

The photographic material of the present invention is preferably processed in an automatic developing machine, and, in this case, negative images having satisfactorily super high contrastcontrasty characteristics can be attained even if the total processing time during which the light-sensitive material fed is passed through the steps of development, fixing, washing, and drying, and is subsequently recovered in as short as 90–120 seconds.

The following examples are given for the purpose of further illustrating the present invention, but should in no sense be taken as limiting the invention.

EXAMPLE 1

An aqueous solution of silver nitrate and an aqueous solution of potassium bromide/potassium iodide were mixed by the double-jet method in the presence of ammonia while the pAg was kept at 7.9, so as to produce a monodisperse cubic silver iodobromide emulsion A (2 mol % AgI and 98 mol % AgBr) having an average grain size of 0.3 μm.

In a separate step, an aqueous solution of silver nitrate and an aqueous solution of potassium bromide were mixed by the double-jet method in the presence of ammonia while the pAg was held at 7.9, so as to produce a monodisperse cubic silver bromide emulsion B having an average grain size of 0.23 μm.

Silver bromide grains were prepared by the same method as used to prepare an emulsion B, and were subsequently sulfur-sensitized with sodium thiosulfate to produce a silver bromide emulsion C.

An aqueous solution of silver nitrate and an aqueous solution of potassium bromide were mixed by the double-jet method in the presence of ammonia while the pAg was held at 7.9, so as to produce a monodisperse cubic silverbromide emulsion having an average grain size of 0.18 μm. This emulsion was sulfur-sensitized with sodium thiosulfate to prepare an emulsion D.

Each of the emulsions A, B, C and D was spectrally sensitized with $6 \times 10^{-4}$ moles, per mole of silver, of a sensitizing dye (5,5'-dichloro-3,3'-di(3-sulfopropyl)-9-ethyl-oxacarbocyanine sodium salt). To the sensitized emulsion, 4-hydroxy-6-methyl-1,3,3a,7-tetrazaindene was added as a stabilizer.

To the emulsion samples identified by Nos. (1) to (16) in Table 1, an alkylbenzenesulfonate (surfactant) and a vinylsulfonic acid compound (hardening agent) were added, and the pH of each emulsion was subsequently adjusted to 5.8.

To a polyethylene terephthalate support having a thickness of 100 μm, one of the thus prepared emulsions was applied such that the total silver coated in O- and U-layers was 3.2 g/m² and the applied emulsion layers was overlaid with a protective layer for a gelatin coated of 1 g/m². By repeating the same procedures, samples (1) to (16) having the data shown in Table 1 were prepared. The O-layer signifies an overlying layer which is the closer to the protective layer of the two emulsion layers, and the U-layer signifies an underlying layer which is the closer to the support. Both O- and U-layers contained the same amount of a hydrazine compound, I-12, per mole of silver.

TABLE 1

| | O-layer formulation | | | U-layer formulation | | |
|---|---|---|---|---|---|---|
| Sample No. | Emulsion | Silver coated (g/m²) | Compound I-12 ($10^{-3}$ mol/mol Ag) | Emulsion | Silver coated (g/m²) | Compound I-12 ($10^{-3}$ mol/mol Ag) |
| 1 | A | 3.2 | 0.5 | — | — | — |
| 2 | B | 3.2 | 0.5 | — | — | — |
| 3 | C | 3.2 | 0.5 | — | — | — |
| 4 | D | 3.2 | 0.5 | — | — | — |
| 5 | A | 1.6 | 3.0 | B | 1.6 | 3.0 |
| 6 | A | 1.6 | 5.0 | B | 1.6 | 5.0 |
| 7 | A | 0.8 | 3.0 | B | 2.4 | 3.0 |
| 8 | A | 0.8 | 5.0 | B | 2.4 | 5.0 |
| 9 | A | 1.6 | 3.0 | C | 1.6 | 3.0 |
| 10 | A | 1.6 | 5.0 | C | 1.6 | 5.0 |
| 11 | A | 0.8 | 3.0 | C | 2.4 | 3.0 |
| 12 | A | 0.8 | 5.0 | C | 2.4 | 5.0 |
| 13 | A | 1.6 | 3.0 | D | 1.6 | 3.0 |
| 14 | A | 1.6 | 5.0 | D | 1.6 | 5.0 |
| 15 | A | 0.8 | 3.0 | D | 2.4 | 3.0 |
| 16 | A | 0.8 | 5.0 | D | 2.4 | 5.0 |

Each of the thus prepared samples was exposed for 5 seconds under a tungsten lamp (3200° K.) through a sensitometric optical wedge, and was subsequently developed at 38° C. for 30 seconds with a developer having the formulation shown below. The developed sample was then fixed, washed with water, and dried. Development and subsequent processing were performed with an automatic developer, FG-660F, of Fuji Photo Film Co., Ltd.

| Developer formulation | |
|---|---|
| Hydroquinone | 35.0 g |
| N-methyl-p-aminophenol hemisulfate | 0.8 g |
| Sodium hydroxide | 9.0 g |
| Tertiary potassium phosphate | 74.0 g |
| Potassium sulfite | 90.0 g |
| Ethylenediaminetetraacetic acid disodium salt | 1.0 g |
| Potassium bromide | 3.0 g |
| 5-Methyl benzotriazole | 0.6 g |
| 3-Diethylamino-1-propanol | 15.0 g |
| Water to make | 1000 ml (pH = 11.6) |

The photographic characteristics of the processed samples are shown in Table 2.

The relative sensitivity data were represented in terms of the reciprocal of the amount of exposure necessary to provide a density of 1.5, with the value for sample (1) being taken as 100. The contrast ($\gamma$) data were indicated in terms of the average gradation over the density range of from 0.3 to 3.0. Evaluation of the occurrence of black peppers was conducted in the following manner: the number of black pepper spots that occurred in unexposed areas of a sample was counted under examination with a magnifying glass (×25) and rating was made on a five-score basis, with 5 being assigned to the samples which were substantially free from the occurrence of black pepper and 1 being assigned to those which were affected most severely. Scores of 3 and upward were taken to indicate levels acceptable for practical use.

TABLE 2

| Sample No. | Relative Sensitivity | Contrast (γ) | $D_{max}$ | Black pepper | Remarks |
|---|---|---|---|---|---|
| 1 | 100 | 15.0 | 4.1 | 5 | Comparison |
| 2 | 33 | 6.5 | 4.6 | 5 | Comparison |
| 3 | 48 | 17.5 | 5.3 | 3 | Comparison |
| 4 | 31 | 14.0 | 5.8 | 4 | Comparison |
| 5 | 52 | 7.4 | 3.6 | 5 | Comparison |
| 6 | 60 | 8.1 | 4.3 | 5 | Comparison |
| 7 | 47 | 6.9 | 3.7 | 5 | Comparison |
| 8 | 56 | 7.5 | 4.4 | 5 | Comparison |
| 9 | 91 | 12.0 | 4.6 | 5 | Invention |
| 10 | 98 | 16.5 | 4.8 | 5 | Invention |
| 11 | 89 | 12.5 | 4.9 | 4 | Invention |
| 12 | 95 | 17.0 | 5.1 | 4 | Invention |
| 13 | 87 | 11.5 | 4.9 | 5 | Invention |
| 14 | 93 | 13.5 | 5.1 | 5 | Invention |
| 15 | 89 | 12.0 | 5.2 | 5 | Invention |
| 16 | 95 | 14.5 | 5.6 | 4 | Invention |

As is clear from Table 2, Sample Nos. 1 to 4, each having a single emulsion layer, exhibited a lower sensitivity (except for Sample No. 1) and $D_{max}$ than Sample Nos. 9 to 16, each having a double-layered emulsion coat. Sample Nos. 5 to 8, using emulsion B, which had a gamma value of less than 10, experienced a drop in sensitivity, and their final gamma values were also 10 or less.

The data for Sample Nos. 12 and 16 show the following: by employing a dual structure wherein emulsion A and emulsion C or D were coated in two layers, a sensitivity that was substantially equal to that of the more sensitive emulsion A was attained, and a $D_{max}$ that was close to the higher-density emulsion C or D was attained; these effects became more pronounced as the ratio of C/A or D/A increased.

As will be understood from the foregoing description, the silver halide photographic material of the present invention that contains a hydrazine derivative and which employs a multi-layered structure of two or more emulsions having different average grain sizes (as when a fine-grained emulsion and a coarse-grained emulsion are coated in two layers) exhibits the very useful advantage of reduced occurrence of black pepper while attaining a high optical density and contrast without sacrificing the high sensitivity.

EXAMPLE 2

By performing the formation of silver halide grains in the existence of $(NH_4)_3RhCl_6$ and $K_3IrCl_6$, an aqueous solution of silver nitrate and an aqueous solution of silver halide containing the rhodium salt of $1\times10^{-6}$ mol/mol-Ag and the iridium salt of $4\times10^{-7}$ mol/mol-Ag were mixed by the double-jet method in the presence of ammonia while the pAg was kept at 7.9 under 45° C. for 60 minutes, so as to produce a monodisperse cubic silver chloroiodobromide emulsion (0.1 mol % AgI and 30 mol % AgBr) having an average grain size of 0.25 μm.

This emulsion was washed with water to remove salts and then was sulfur-sensitized with sodium thiosulfate to prepare an emulsion E.

An aqueous solution of silver nitrate and an aqueous solution of silver halide which are the same as the emulsion E, were mixed by the double-jet method in the presence of ammonia while the pAg was kept at 7.9 under 40° C. for 30 minutes, so as to produce a monodisperse cubic silver chloroiodobromide emulsion (0.1 mol % AgI and 30 mol % AgBr) having an average grain size of 0.19 μm.

This emulsion was washed with water to remove salts and then was gold/sulfur-sensitized to prepare an emulsion F.

Each of the above emulsions E and F and the emulsion A used in Example 1 was spectrally sensitized with $3\times10^{-4}$ moles, per mole of silver, of 1-(2-hydroxyethoxyethyl)-3-(pyridine-2-yl)-5-[(3-sulfobutyl-5-chloro-2-benzooxsazolinidene)ethylidene]-2-thiohydantoine potassium salt as a sensitizing dye.

To each of the sensitized emulsions, 1.5 g/mol-Ag of 4-hydroxy-6-methyl-1,3,3*a*,7-tetrazaindene, 2 g/mol-Ag of hydroquinone, 2 g/mol-Ag of resolcine aldoxime, and 0.1 g/mol-Ag of 1-phenyl-5-mercapto tetrazole were added as a stabilizer, and further, a compound of the following formula:

$$C_{17}H_{30}CON(CH_3)CH_2CH_2SO_3Na$$

and saponin (coating aid), a compound of the following formula: $CH_2{=}CHSO_2CH_2CONH(CH_2)_nNHCOCH_2SO_2CH{=}CH_2$ (n=2 or 3) (hardener), a polystyrenesulfonate (thickner), and a dispersion of polyethyl acrylate (latex polymer) were added.

After a hydrazine compound I-12 was added thereto, 0-, M-, and U-layers and the protective layer which is composed of gelatin, dodecylbenzenesulfonate, silicone oil, colloidal silica, polyethyl acrylate, polymethyl methacrylate (average grain size: 2 μm) and polystyrene sulfonic acid were coated on a support at the same time to prepare Sample Nos. 17 to 23 as shown in Table 3.

The M-layer signifies an emulsion layer between O-layer and U-layer when three emulsion layers are applied to a support.

TABLE 3

| | O-layer formation | | | M-layer formation | | | U-layer formation | | |
|---|---|---|---|---|---|---|---|---|---|
| Sample No. | Emulsion | Silver coated (g/m²) | Compound I-12 ($10^{-3}$ mol/mol-Ag) | Emulsion | Silver coated (g/m²) | Compound I-12 ($10^{-3}$ mol/mol-Ag) | Emulsion | Silver coated (g/m²) | Compound I-12 ($10^{-3}$ mol/mol-Ag) |
| 17 | A | 3.2 | 5.0 | — | — | — | — | — | — |
| 18 | E | 3.2 | 0.8 | — | — | — | — | — | — |
| 19 | F | 3.2 | 0.2 | — | — | — | — | — | — |
| 20 | A | 1.6 | 5.0 | F | 1.6 | 0.2 | — | — | — |
| 21 | F | 1.6 | 0.2 | A | 1.6 | 5.0 | — | — | — |

TABLE 3-continued

| Sample No. | O-layer formation Emulsion | Silver coated (g/m²) | Compound I-12 ($10^{-3}$ mol/mol-Ag) | M-layer formation Emulsion | Silver coated (g/m²) | Compound I-12 ($10^{-3}$ mol/mol-Ag) | U-layer formation Emulsion | Silver coated (g/m²) | Compound I-12 ($10^{-3}$ mol/mol-Ag) |
|---|---|---|---|---|---|---|---|---|---|
| 22 | A | 1.0 | 5.0 | E | 1.1 | 0.8 | F | 1.1 | 0.2 |
| 23 | F | 1.0 | 0.2 | E | 1.1 | 0.8 | A | 1.1 | 5.0 |

Each of the thus prepared samples was exposed, developed, fixed, washed with water, and dried in the same manner as described for Example 1.

The photographic characteristics of the processed samples are shown in Table 4.

TABLE 4

| Sample No. | Relative Sensitivity | Contrast (γ) | $D_{max}$ | Black pepper | Remarks |
|---|---|---|---|---|---|
| 17 | 100 | 16.0 | 3.8 | 5 | Comparison |
| 18 | 52 | 15.5 | 4.9 | 3 | Comparison |
| 19 | 48 | 17.0 | 5.4 | 2 | Comparison |
| 20 | 98 | 16.5 | 5.0 | 5 | Invention |
| 21 | 95 | 16.0 | 5.1 | 4 | Invention |
| 22 | 95 | 17.0 | 5.1 | 5 | Invention |
| 23 | 91 | 16.5 | 5.3 | 5 | Invention |

As is clear from Table 4, Sample Nos. 20 to 23, each having two or three emulsion layers of the present invention, exhibited a higher $D_{max}$ than Sample No. 17 having a single emulsion layer and a higher sensitivity and a lower black pepper than Sample Nos. 18 and 19 having a single emulsion layer.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a surface latent image type silver halide emulsion layer unit on a support, and containing a hydrazine compound in at least one of said emulsion layer unit and other constituent layers, said emulsion layer unit being composed of at least two layers, one of which is a fine-grained low sensitivity emulsion layer and one of which is a coarse-grained high-sensitivity emulsion layer, with the silver halide emulsion present in the fine-grained low sensitivity emulsion layer having an average grain size of not more than 80% of the average grain size of the coarse-grained high-sensitivity silver halide emulsion in the coarse-grained high-sensitivity emulsion layer, and said silver halide photographic material attains a contrast of 10 or more in terms of gamma value when a developer containing at least 0.15 mole/liter of sulfite ions and having a pH of from 9.5 to 12.3 is used, wherein the hydrazine compound is represented by formula (I):

$$R_1—NHNH—G—R_2$$

wherein $R_1$ is an aliphatic group or an aromatic group; $R_2$ is a hydrogen atom, a substituted or unsubstituted alkyl group, a substituted or unsubstituted aryl group, a substituted or unsubstituted alkoxy group; or a substituted or unsubstituted aryloxy group; and G represents a carbonyl group, a sulfonyl group, a sulfoxy group, a phosphoryl group, or an N-substituted or unsubstituted iminomethylene group, said silver halide photographic material consisting essentially of said surface latent image type silver halide emulsion layer unit.

2. A silver halide photographic material as in claim 1, wherein the difference in sensitivity between the coarse-grained high-sensitivity emulsion and the fine-grained low-sensitivity emulsion is from 0.1 to 1.0 in terms of Δ log E.

3. A silver halide photographic material as in claim 1, wherein the difference in sensitivity between the coarse-grained high-sensitivity emulsion and the fine-grained low-sensitivity emulsion is from 0.2 to 0.7 in terms of Δ log E.

4. A silver halide photographic material as in claim 1, wherein the fine-grained emulsion comprises from 40 to 90 wt % of the total silver content of the emulsion layer unit.

5. A silver halide photographic material as in claim 1, wherein the fine-grained emulsion comprises from 50 to 80 wt % of the total silver content of the emulsion layer unit.

6. A silver halide photographic material as in claim 1, wherein said hydrazine compound is incorporated in said emulsion layer unit in an amount of from $1\times10^{-6}$ to $5\times10^{-2}$ moles per mole of silver halide in said emulsion layer unit.

7. A silver halide photographic material as in claim 1, wherein said hydrazine compound is incorporated in said emulsion layer unit in an amount of from $1\times10^{-5}$ to $2\times10^{-2}$ moles per mole of silver halide in said emulsion layer unit.

8. An image-forming method using a silver halide photographic material comprising a surface latent-image forming silver halide emulsion layer unit on a support, and containing a hydrazine compound in at least one of said emulsion layer unit and other constituent layers, said emulsion layer unit being composed of at least two layers, one of which is a fine-grained low sensitivity emulsion layer and one of which is a coarse-grained high-sensitivity emulsion layer, with the silver halide emulsion present in the fine-grained low-sensitivity emulsion layer having an average grain size of not more than 80% of the average grain size of the coarse-grained high-sensitivity silver halide emulation in the coarse-grained high-sensitivity emulsion layer wherein said silver halide photographic material is subjected to an imagewise exposure and subsequently developed with a developer that contains at least 0.15 mole/liter of sulfite ions and has a pH of from 9.5 to 12.3, so as to produce a contrast of 10 or more in terms of gamma value, wherein the hydrazine compound is represented by formula (I):

$$R_1-NHNH—G—R_2$$

wherein $R_1$ is an aliphatic group or an aromatic group, $R_2$ is a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, said silver halide photographic material consisting essentially of said surface latent image type silver halide emulsion layer unit.

9. An image-forming method using a silver halide photographic material as in claim 8, wherein the difference in sensitivity between the coarse-grained high-sensitivity emulsion and the fine-grained low-sensitivity emulsion is rom 0.1 to 1.0 in terms of Δlog E.

10. An image-forming method using a silver halide photographic material as in claim 8, wherein the difference in sensitivity between the coarse-grained high-sensitivity emulsion and the fine-grained low-sensitivity emulsion is from 0.2 to 0.7 in terms of Δlog E.

11. An image-forming method using a silver halide photographic material as in claim 8, wherein the fine-grained emulsion comprises from 40 to 90 wt % of the total silver content of the emulsion layer unit.

12. An image-forming method using a silver halide photographic material as in claim 8, wherein the fine-grained emulsion comprises from 50 to 80 wt % of the total silver content of the emulsion layer unit.

13. An image-forming method using a silver halide photographic material as in claim 8, wherein said hydrazine compound is incorporated in said emulsion layer unit in an amount of from $1\times10^{-6}$ to $5\times10^{-2}$ moles per mole of silver halide in said emulsion layer unit.

14. An image-forming method using a silver halide photographic material as in claim 8, wherein said hydrazine compound is incorporated in said emulsion layer unit in an amount of from $1\times10^{-5}$ to $2\times10^{-2}$ moles per mole of silver halide in said emulsion layer unit.

15. An image-forming method using a silver halide photographic material as in claim 8, wherein said developer contains sulfite ions of from 0.15 to 2.5 moles/liter.

16. An image-forming method using a silver halide photographic material as in claim 8, wherein said developer contains sulfite ions of from 0.4 to 2.5 moles/liter.

17. A silver halide photographic material as in claim 1, wherein the hydrazine compound of Formula (I) is added to a solution of the silver halide emulsion after completion of chemical ripening.

18. An image-forming method using a silver halide photographic material as in claim 8, wherein the hydrazine compound of Formula (I) is added to a solution of the silver halide emulsion after completion of chemical ripening.

* * * * *